United States Patent [19]

Abkowitz et al.

[11] Patent Number: 4,852,531

[45] Date of Patent: Aug. 1, 1989

[54] TITANIUM POPPET VALVE

[75] Inventors: Stanley Abkowitz, Lexington; Harold L. Heussi, Essex; Harold P. Ludwig, Woburn; Stephen A. Kraus, Clinton, all of Mass.

[73] Assignee: Dynamet Technology Inc., Burlington, Mass.

[21] Appl. No.: 166,503

[22] Filed: Mar. 10, 1988

[51] Int. Cl.[4] ..... F01L 3/00

[52] U.S. Cl. ..... 123/188 AA; 123/90.51; 251/368; 29/156.7

[58] Field of Search ..... 123/188 AA, 90.51; 251/368; 29/156.7

[56] References Cited

U.S. PATENT DOCUMENTS

| | | | |
|---|---|---|---|
| 2,037,340 | 4/1936 | Rich | 123/188 AA |
| 2,048,166 | 7/1936 | Pilling et al. | 123/188 AA |
| 3,300,303 | 1/1967 | Leach | 75/208 |
| 4,004,889 | 1/1977 | Gale et al. | 29/182.2 |
| 4,073,474 | 2/1978 | Hashimoto et al. | 251/368 |
| 4,433,652 | 2/1984 | Holtzberg et al. | 123/188 AA |
| 4,606,883 | 8/1986 | Wizemann et al. | 427/383.7 |
| 4,632,074 | 12/1986 | Takahashi et al. | 123/188 AA |
| 4,729,546 | 3/1988 | Allison | 123/188 AA |

OTHER PUBLICATIONS

J. E. Allison et al., "Titanium in Engine Valve Systems", Journal of Metals, Mar. 1987, pp. 15–18.

*Primary Examiner*—E. Rollins Cross

*Attorney, Agent, or Firm*—Finnegan, Henderson, Farabow, Garrett & Dunner

[57] ABSTRACT

A poppet valve having a valve stem of titanium alloy strengthened by the inclusion of a compound containing titanium such as TiC, TiB or $TiB_2$. The valve stem is joined to a valve head formed from a powder of a titanium alloy, preferably of the same composition as the alloy of the stem. The head and the stem are joined by cold compaction followed by vacuum sintering and a high temperature compaction.

6 Claims, 2 Drawing Sheets

TITANIUM POPPET VALVE

BACKGROUND OF THE INVENTION

The present invention relates to a poppet valve for use in an internal combustion engine. Increased interest in improved fuel efficiency and increased power output of internal combustion engines has resulted in the internal combustion engines being operated at higher temperatures and at greater engine speeds. This places severe demands on all of the reciprocating components in the engine, including those in the valve train. In order to improve efficiency and fuel economy, the weight of all components that reciprocate is minimized.

In the case of the poppet valve components of the valve train, however, severe operating conditions place constraints on the materials that can be used to construct such valves. Poppet valves operate under severe conditions. The stem of the valve is subjected to cyclic loading at one end, sliding friction along its length and sometimes bending loads caused by misalignment of the valve head and the valve seat. The valve head is subjected to the most severe conditions, one side of which being exposed to the extremely high temperatures of combustion. In the case of the exhaust valve, the stem side face of the valve is subjected to the flow of hot combustion gases and, in addition, must provide an effective closure at the valve seat. Thus, there is repeated impact loading upon closure of the valve under the influence of the valve train.

In light of these conditions, interest has been expressed in forming such poppet valves from titanium alloys. An article entitled, "Titanium in Engine Valve Systems," by J. E. Allison et al., *Journal of Metals,* March 1987, pp. 15–18, fully discloses the reasoning behind the interest in titanium poppet valves for use in internal combustion engines.

In response to the demand for higher performance of valve train components, a number of different valve configurations have been proposed. U.S. Pat. No. 4,073,474 to Hashimoto et al. discloses a forged poppet valve where the head and part of the neck of the valve are made of a superalloy, while the stem is made of a conventional steel composition. Similarly, U.S. Pat. No. 3,300,303 to Leach discloses making a composite article from a wrought shaft with an end member formed from powder material affixed thereto. FIG. 2 of this reference depicts a poppet valve embodiment. A different approach is set out in U.S. Pat. No. 4,433,652 to Holtzberg et al., which discloses a multipart poppet valve having a stem of plastic material with the head of the valve formed of more heat resistant material, such as metal or ceramic.

All of such efforts are directed to form a lightweight, durable, heat-resistant poppet valve that can stand the environment and mechanical stresses imposed by its use in the valve train of a modern high performance internal combustion engine. Therefore, it is one object of the present invention to provide a titanium poppet valve having properties of the valve head and stem adapted to the physical environment of a high performance internal combustion engine.

It is another object of the present invention to provide a titanium poppet valve that can be readily manufactured by modern powder metallurgy techniques.

It is an additional object of the invention to provide a titanium poppet valve with a head portion of a different composition than the stem portion.

It is a further object of the invention to provide a titanium poppet valve formed of different titanium materials having a bond therebetween with no significant compositional gradient.

Other objects of the invention will be apparent from the description of the preferred embodiment or can be learned from practice of the invention.

SUMMARY OF THE INVENTION

To achieve these and other objects of the invention, there is provided a poppet valve comprised of a valve stem and a valve head. The valve stem is formed by extrusion of a rod-like powder preform of a titanium alloy including particles consisting essentially of a compound selected from the group consisting of TiC, TiB and $TiB_2$. The valve head is formed from a powder preform of a titanium alloy. The head is joined to the stem by first subjecting the head and stem to cold compaction while the two are in contact. The joined article is then vacuum sintered and the sintered article is then compacted at high temperature. Preferably, the titanium alloy of the valve stem and the valve head are the same.

BRIEF DESCRIPTION OF THE DRAWINGS

The following figures, which constitute a part of the specification, depict an embodiment of the present invention.

DESCRIPTION OF THE PREFERRED EMBODIMENTS

Figure 1:
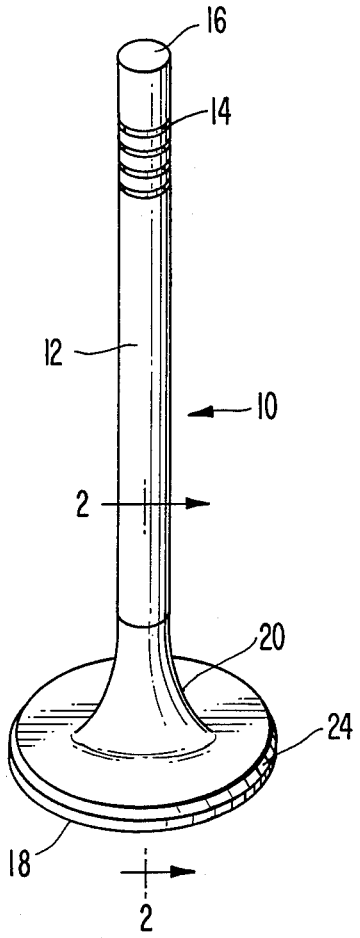
FIG. 1 is a perspective view of an embodiment of the invention.
Figure 2:
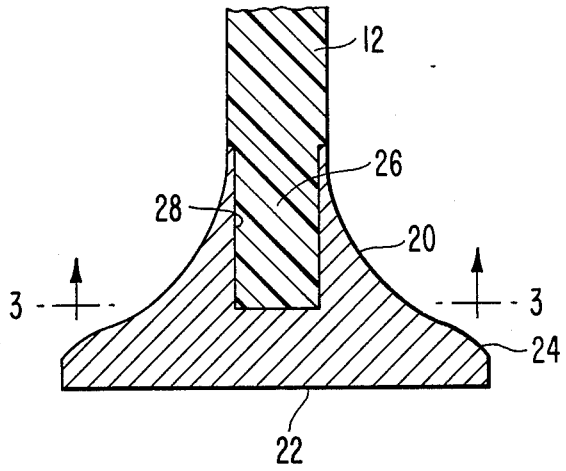
FIG. 2 is a partial cross section of a poppet valve formed in accordance with the present invention.

The present invention is a poppet valve for an internal combustion engine. As here embodied in FIGS. 1 and 2, there is provided a conventionally configured poppet valve 10 having a stem 12 and a plurality of grooves 14 disposed to retain a valve-spring keeper (not shown). The stem includes the end 16 with the opposite end 26 embedded within the head portion 18 of the valve 10. In accordance with the invention, the valve stem is formed by extrusion of a rod-like powder preform of a titanium alloy including particles consisting essentially of compounds selected from the group consisting of titanium carbide (TiC), titanium boride (TiB) and titanium diboride ($TiB_2$). Preferably, the particle sizes and relative proportions of the titanium alloy and the compounds are such that the resulting component is a metal matrix composite. A number of different titanium alloys can be used, including Ti-6Al-4V, Ti-6Al-6V-2Sn, Ti-6Al-2Sn-4Zr-2Mo, Ti-10V-2Fe-3Al or Ti-5Al-2.5Sn. Pure titanium may also be used, however, its properties are not as advantageous in the present invention as those of the aforementioned titanium alloys. These titanium alloys are formed into a powder by conventional powder fabrication techniques. Preferably, the titanium alloy is in a powder in the size range of from about 50 to 150 microns. The resulting article is strengthened by including therein particles of titanium carbide, titanium boride or titanium diboride. The size of the particles is preferably in the range of from about 3 to 20 microns with the compound forming from about 20 to 35 weight percent of the mixture with the titanium alloy. The mixture of titanium alloy and particles is formed into a rod-like powder preform by a conventional forming technique such as cold compaction or the like.

In accordance with the invention, the valve includes a valve head formed from a powder preform of a titanium alloy. The titanium alloys that may be used to form the valve head include the same alloys set out with respect to the valve stem. It is preferred to have the titanium alloy of the valve stem be the same titanium alloy used in the valve head, although this is not necessary if the interdiffusion of elements at the interface has no detrimental effect to the final product. The valve head may be formed by conventional consolidation techniques including sintering, hot compaction or hot isostatic pressing.

In accordance with the invention, the head is joined to the stem by first cold compacting the stem and the head while they are in contact. As here embodied and depicted in FIG. 2, one extremity 26 of the stem 12 is inserted into an opening 28 in the valve head 18. For the materials of the present embodiment the cold compaction is done isostatically in a liquid at a pressure of from about 40 to 60 Ksi. The components are held at this pressure for a short time, generally in the range of from 5 to 15 seconds. This step mechanically joins the components as well as provides some strain energy that affects subsequent steps in the fabrication.

Figure 3:
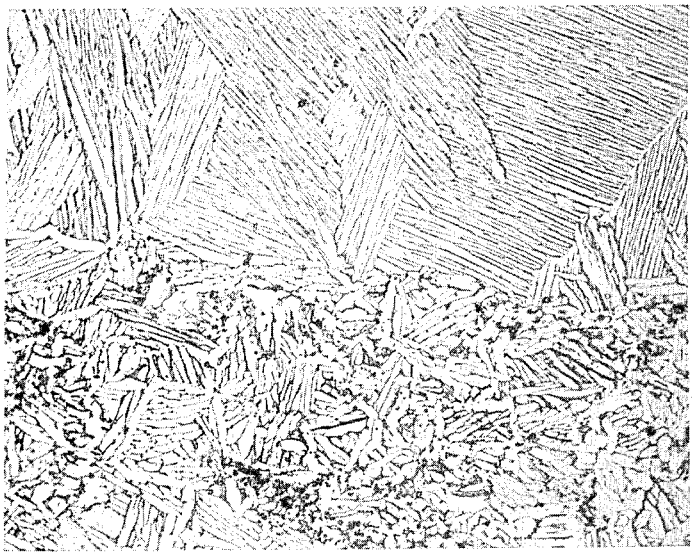
FIG. 3 is a photomicrograph showing the interface between the stem and head portion.

Subsequently, the joined article is vacuum sintered at a temperature in the range of from about 2200°±25° F. for about 2 hours. The vacuum sintering results in increased density, alloying and the formation of a metallurgical bond at the interface of the stem and the head through interdiffusion at the interface. The vacuum sintered article is subsequently compacted at elevated temperatures to achieve the desired density. The diffusion associated with the vacuum sintering and high temperature compaction of the two components forms a bond at the interface between the two components with the bond having no appreciable composition gradient. While the stem 12 may include a strengthening material, the matrix of the stem is titanium alloy of preferably the same basic composition as that of the head 18. Therefore, after the compaction and high temperature diffusion of the stem and the head in contact with one another, there is formed a bond between the two sufficient to join the articles for service as a poppet valve in an internal combustion engine. Such a bond is depicted in FIG. 3 which is a photomicrograph at 250× of an actual interface between two such materials.

The primary advantage of the use of the same alloy for the matrix of the stem and for the head of the valve is that due to the similarity of composition, there is considerably less likelihood of stresses developing because of differences in the coefficients of thermal expansion between the two components. In addition, there is a similarity in composition which reduces the possibility of diffusion of dissimilar materials from one component to the other that may cause embrittlement or stress corrosion.

Figure 4:
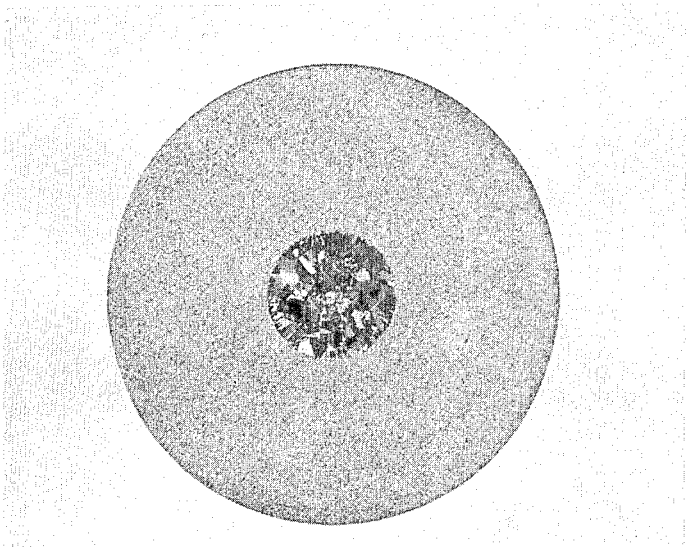
FIG. 4 is a photomicrograph showing the grain structure of the head and stem portion.

The joinder of the stem with the head also allows the resultant article to have similar compositions but much different microstructures and properties. The presence of the titanium compounds in the stem is only one such difference and the stem may have an entirely different grain structure and properties than that of the head. As depicted in FIG. 4, the head is comprised of an extremely fine grained material with the stem having a much more coarse microstructure. While such a structure could be developed in a monolithic article, as for example by heat treatment of the stem to promote grain growth, the formation of the article from two separate components allows complete tailoring of the properties of the head and the stem which may not be possible by forming the device from monolithic stock material.

In a preferred embodiment the high temperature compaction is accomplished by hot isostatic pressing. Particular success has been experienced with a metal matrix composite of Ti-6Al-4V and TiC for the stem and Ti-6Al-4V for the head using a hot isostatic pressing pressure of 25 Ksi for a period of 4 hours at a temperature of 2165° F. in a protective atmosphere. Under such conditions, both the power preform of the stem and the head portion are fully densified and the two components are joined to form an effective bond at the interface. Subsequent to the joining and consolidation treatments, the valve may be machined by techniques known to those skilled in the art to produce the confirmation of the final poppet valve.

The present invention has been disclosed in terms of a preferred embodiment. The scope of the invention, however, is not determined by the disclosed embodiment but rather by the appended claims and their equivalents.

What is claimed is:

1. A poppet valve comprising:

a valve stem formed by extrusion of a rod-like powder preform of a titanium alloy including particles consisting essentially of compounds selected from the group consisting of TiC, $TiB_2$ and TiB; and a valve head formed from a powder preform of a titanium alloy, said head being joined to said stem by cold compaction of said stem and head while said stem and said head are in contact followed by vacuum sintering of the joined article followed by high temperature compaction of the vacuum sintered article.

2. The poppet valve of claim 1 wherein said titanium alloy of said valve stem and said valve head are the same.

3. The poppet valve of claim 1 wherein the titanium alloy of said valve stem is selected from the group consisting of Ti-6Al-4V, Ti-6al-6V-2Sn, Ti-6Al-2Sn-4Zr-2Mo, Ti-10V-2Fe-3Al or Ti-5Al-2.5Sn.

4. The poppet valve of claim 2 wherein the titanium alloy of the valve stem and the valve head is selected from the group consisting of Ti-6Al-4V, Ti-6Al-6V-2Sn, Ti-6Al-2Sn-4Zr-2Mo, Ti-10V-2Fe-3Al or Ti-5Al-2.5Sn.

5. The poppet valve of claim 1 wherein the vacuum sintered article is compacted by hot isostatic pressing.

6. The poppet valve of claim 1 wherein the stem is a metal matrix composite.

* * * * *